United States Patent [19]

Kraft et al.

[11] Patent Number: 4,974,517

[45] Date of Patent: Dec. 4, 1990

[54] AMMUNITION WITH PROPULSION MECHANISM

[75] Inventors: Josef Kraft, Berg; Wolfgang Stein, Lauf; Adolf Weber, Neunkirchen, all of Fed. Rep. of Germany

[73] Assignee: Diehl GmbH & Co., Nuremberg, Fed. Rep. of Germany

[21] Appl. No.: 451,203

[22] Filed: Dec. 15, 1989

[30] Foreign Application Priority Data

Dec. 22, 1988 [DE] Fed. Rep. of Germany ..... 3843289

[51] Int. Cl.[5] ..... F42B 14/06

[52] U.S. Cl. ..... 102/521; 102/430; 102/439

[58] Field of Search ..... 102/430, 439, 520, 521, 102/523

[56] References Cited

U.S. PATENT DOCUMENTS

| | | | |
|---|---|---|---|
| 3,981,246 | 9/1976 | Luther et al. | 102/430 |
| 4,542,696 | 9/1985 | Bisping et al. | 102/430 |
| 4,619,201 | 10/1986 | Romer et al. | 102/283 |
| 4,651,649 | 3/1987 | Nussbaum | 102/521 |
| 4,671,182 | 6/1987 | Zierler et al. | 102/521 |
| 4,688,465 | 8/1987 | Melhus et al. | 102/430 |
| 4,756,255 | 7/1988 | Rosenberg et al. | 102/521 |
| 4,763,577 | 8/1988 | Romer et al. | 102/430 |

FOREIGN PATENT DOCUMENTS

| | | | |
|---|---|---|---|
| 2606500 | 5/1988 | European Pat. Off. . | |
| 281462 | 9/1988 | European Pat. Off. | 102/430 |
| 2836963 | 3/1984 | Fed. Rep. of Germany . | |
| 131034 | 8/1919 | United Kingdom . | |
| 2154717 | 9/1985 | United Kingdom . | |

*Primary Examiner*—Charles T. Jordan
*Assistant Examiner*—Rochelle Lieberman
*Attorney, Agent, or Firm*—Scully, Scott Murphy & Presser

[57] ABSTRACT

An article of ammunition with propulsion mechanism, incorporating a fin-stabilized projectile, the propulsion mechanism, a casing for a propellant, and a propellent charge, and wherein the propulsion mechanism includes an empty volume or open void intermediate front and rear guidance segments thereof.

10 Claims, 1 Drawing Sheet

AMMUNITION WITH PROPULSION MECHANISM

BACKGROUND OF THE INVENTION

1. Field of the Invention

The present invention relates to an article of ammunition with propulsion mechanism, incorporating a fin-stabilized projectile, the propulsion mechanism, a casing for a propellant, and a propellent charge, and wherein the propulsion mechanism includes an empty volume or open void intermediate guidance segments thereof.

2. Discussion of the Prior Art

For an extremely lengthy fin-stabilized projectile, such as is disclosed in German Patent No. 28 36 963 C2, the empty volume or void in a propulsion mechanism; in essence, that is the space which is present between the forward and rearward guidance segment, consists of approximately 2 to 3 $dm^3$. In order to be able to increase the power of this fin-stabilized projectile, among other conditions, the empty volume or void is filled with a powder propellant.

Furthermore, also known in the art is a compacted propellent charge, as described in the disclosure of German Patent No. 33 32 224 A1. This measure also serves to enhance the power of the ammunition.

When the density of the charge for an article of ammunition pursuant to German Patent No. 28 36 963 C2 is increased in comparison with an ordinarily poured propellant, in conformance with the disclosure of German Patent No. 33 32 224 A1, there is then encountered the danger of an excessively high pressure build-up in the shell or cartridge chamber during firing, with the consequence of imparting damage to the breech closure of the weapon.

SUMMARY OF THE INVENTION

Accordingly, it is an object of the present invention to provide, in a novel manner, an increase in the power of the fin-stabilized projectile without exerting any negative influence over the weapon.

The foregoing object is achieved through an article of ammunition with a propulsion mechanism of the type described herein, whereby the propulsion mechanism has a forward gas-tight guidance segment and a rear guidance segment which is adapted for the through-passage of propellant gases, and a compacted propellent charge which closes off with the rear guidance segment.

It is of importance to the invention that, independently of a constructive change of the rear guidance segment, no changes or modifications of any kind need be carried out to the article of ammunition. The compacted propellant fills out the entire available propellant chamber; meaning, that there is no presence of an empty volume or void in the shell or cartridge chamber. In order to avoid any impermissible excess pressure build-up generated during the combustion or burning down of the propellant, the void or empty volume in the propulsion mechanism serves this purpose.

The invention is also applicable to articles of ammunition with propulsion mechanisms possessing a divided charge. In this type of ammunition there is provided a rupture location in the region of the charge.

BRIEF DESCRIPTION OF THE DRAWINGS

Reference may now be had to the following detailed description of exemplary embodiments of the invention, taken in conjunction with the accompanying drawings; in which.

DETAILED DESCRIPTION

Figure 1:
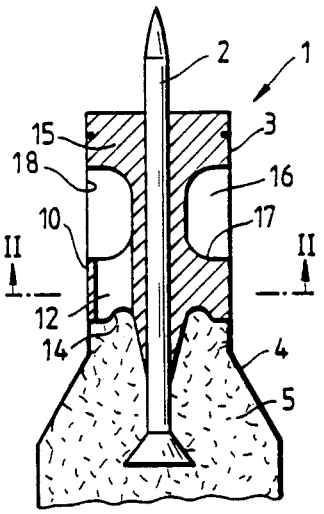
FIG. 1 illustrates a fragmentary longitudinal sectional view of an article of ammunition with a propulsion mechanism pursuant to the invention.
Figure 2:
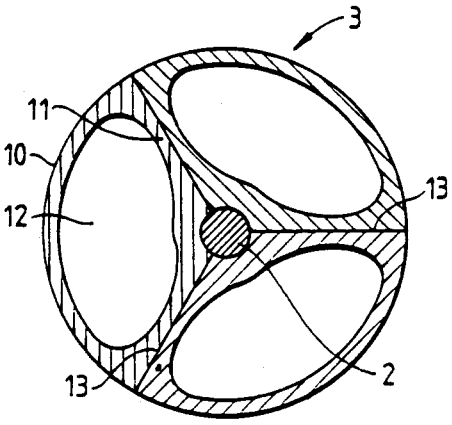
FIG. 2 illustrates a sectional view taken along line II—II in FIG. 1.

In accordance with FIG. 1 of the drawings, an article of ammunition with a propulsion mechanism 1 consists of a fin-stabilized projectile 2 with a usual three-part propulsion mechanism 3, a casing 4 for a propellant, and with a propellent charge 5. The propellant casing 4 is fastened to a rear guidance segment 10 of the propulsion mechanism 3. The rear guidance segment 10, in accordance with FIG. 2, possesses connectors 11 with large-volumed openings 12 therebetween. The contacting joints ar designated with reference numeral 13.

The openings 12 are covered with a combustible foil 14 with regard to the compacted propellent charge 5.

The propulsion mechanism 3 possesses an empty volume or open void 16 in the space intermediate the front guidance segment 15 and the rear guidance segment 10 due to the provision of a rotationally-symmetrically surrounding cutout 17. This cutout 17 can be covered with a combustible sleeve 18 extending about its circumference.

For the transmitting of the propelling forces to the fin-stabilized projectile 2, provided between the latter and the propulsion mechanism 3, in a known manner, is a form-fitted or load-transmissive connection (not shown).

Figure 3:
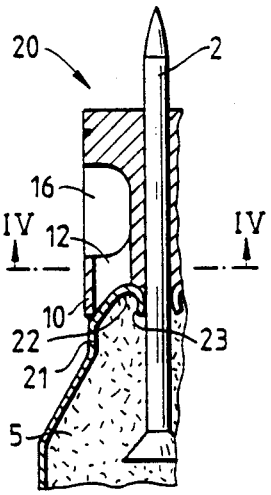
FIG. 3 illustrates a modified embodiment of an article of ammunition with a propulsion mechanism.
Figure 4:
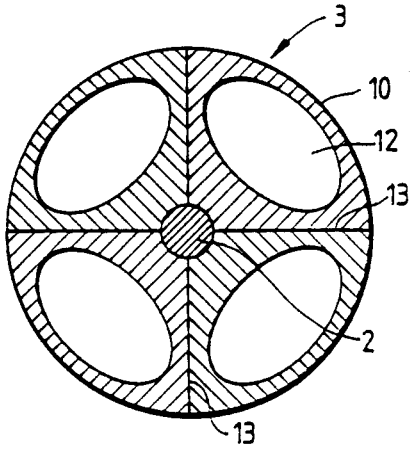
FIG. 4 illustrates a sectional view through the ammunition taken along line IV—IV in FIG. 3.

A further embodiment of an article of ammunition with propulsion mechanism 20 can be ascertained from FIGS. 3 and 4. Functionally identically or similarly acting components, in conformance with the components of the ammunition with propulsion mechanism 1, are identified by the same reference numerals. Deviating from the embodiment of the ammunition with propulsion mechanism 1, the ammunition with propulsion mechanism 20 possesses a combustible sleeve 21. The sleeve 21 possesses a rolled-in or turned-in sleeve head 22 which, at the one end, is fixedly connected with the rear guidance segment 10 through the intermediary of a suitable adhesive, and contacts against the fin-stabilized projectile 2. As a result thereof, the sleeve head 22 covers the openings 12 in the rear guidance segment 10. In this construction, the cutout 17 extending the circumference need not be covered, and a foil for covering the openings 12 can likewise be eliminated.

Pursuant to FIG. 4 there is disclosed a propulsion mechanism 3 with two intersecting contact seams 13 and cutouts or openings 12.

The functioning of the inventive arrangement is as follows:

After the triggering of the propellent charge 5 of the ammunitions 1, 20 there is thereafter loosened the connection between the propellant casing 4, 21 from the propulsion mechanism 3, in that the propulsion mechanism 3 together with the fin-stabilized projectile 2 is moved forwardly. The gases from the propellant stream into the newly created space between the propulsion mechanism and the propellant casing as well as into the empty volume or void 16. As a consequence of the foregoing, the maximum gas pressure in the weapon is limited to a permissible value.

Applicable for use as a compacted propellent charge, are all propellants with a high charging density; they can be constituted of charges which are not artificially compacted, such as extremely fine-grained charges, as well as also charges which are compressed or jarred or vibrated, or compacted in any suitable manner.

What is claimed is:

1. Ammunition with propulsion mechanism including a fin-stabilized projectile, said propulsion mechanism encompassing an elongate body portion of said projectile; a casing for a propellant and a propellant contained therein being attached to a tail end of said propulsion mechanism, said propulsion mechanism including a gas-tight front guidance segment and a rear guidance segment, said guidance segments forming a void therebetween at least one through-passage in said rear guidance segment extending between said void and said casing for the propellant, said casing including disintegratable structure closing off the adjacent end of said at least one through-passage whereby said structure is disintegrated and expelled through said at least one through-passage responsive to combustion gases generated by said propellant upon firing of said ammunition enabling said gases to flow into said at least one through-passage and said void intermediate said guidance segments to maintain the generated gas pressure within specified values.

2. Ammunition as claimed in claim 1, wherein said disintegratable structure is an integral constituent of said casing for the propellant.

3. Ammunition as claimed in claim 1, wherein said disintegratable structure is constituted form a combustible material.

4. Ammunition as claimed in claim 2, wherein said casing for the propellant is constituted from a foil material.

5. Ammunition as claimed in claim 4, wherein said foil material is combustible.

6. Ammunition as claimed in claim 1, wherein said casing for the propellant is constituted from a combustible material.

7. Ammunition as claimed in claim 6, wherein said casing includes a turned-in head portion forming said disintegratable structure closing off said at least one through-passage in the rear guidance segment of said propulsion mechanism.

8. Ammunition as claimed in claim 1, wherein said at least one through-passage comprises a major portion of the transverse cross-sectional surface area of said rear guidance segment.

9. Ammunition as claimed in claim 1, wherein said propulsion mechanism includes a plurality of axially-separated segments extending about said projectile, at least one said through-passage being formed in the rear guidance segment of each said propulsion mechanism segment.

10. Ammunition as claimed in claim 1, wherein a sleeve of a combustible material extends about the void intermediate said front and rear guidance segments.

* * * * *

UNITED STATES PATENT AND TRADEMARK OFFICE

CERTIFICATE OF CORRECTION

PATENT NO. : 4,974,517

DATED : December 4, 1990

INVENTOR(S) : Josef Kraft, et al.

It is certified that error appears in the above-identified patent and that said Letters Patent is hereby corrected as shown below:

On the Title page, Section [73]: "Nuremberg" should read as --Nurnberg--

Column 2, line 23: "ar" should read as --are--

Column 4, line 5, Claim 3: "form" should read as --from--

Signed and Sealed this

Ninth Day of June, 1992

*Attest:*

DOUGLAS B. COMER

*Attesting Officer*

*Acting Commissioner of Patents and Trademarks*